US005807478A

United States Patent [19]

Myers et al.

[11] Patent Number: 5,807,478

[45] Date of Patent: Sep. 15, 1998

[54] BITUMEN MODIFICATION USING FLY ASH DERIVED FROM BITUMEN COKE

[75] Inventors: Ronald Damian Myers; Mainak Ghosh; John Brenton MacLeod, all of Calgary, Canada

[73] Assignee: Exxon Research and Engineering Company, Florham Park, N.J.

[21] Appl. No.: 857,887

[22] Filed: May 16, 1997

[51] Int. Cl.[6] ..... C10G 3/00

[52] U.S. Cl. ..... 208/370; 208/107; 208/108

[58] Field of Search ..... 208/107, 370, 208/108; 137/13

[56] References Cited

U.S. PATENT DOCUMENTS

| | | | |
|---|---|---|---|
| 4,214,977 | 7/1980 | Ranganathan | 208/112 |
| 4,299,685 | 11/1981 | Khulbe et al. | 208/112 |
| 4,431,520 | 2/1984 | Giuliani et al. | 208/112 |
| 4,435,280 | 3/1984 | Ranganathan | 208/112 |
| 4,668,380 | 5/1987 | Wolff et al. | 208/115 |
| 4,923,838 | 5/1990 | Khulbe et al. | 208/112 |

*Primary Examiner*—Helane Myers
*Attorney, Agent, or Firm*—Roy J. Ott

[57] ABSTRACT

A method for lowering the viscosity and specific gravity of a heavy hydrocarbon to render it pipelineable is disclosed. The method comprises adding a vanadium and nickel containing coke fly ash to the heavy hydrocarbon; reacting the heavy hydrocarbon in the presence of the fly ash with a molecular hydrogen containing gas under hydroconversion conditions for a time sufficient to lower the viscosity of the hydrocarbon in the range of about 20 to 60 centipoise at 40° C. and to lower the specific gravity in the range of from about 0.925 to about 0.940 at 15° C., whereby the heavy hydrocarbon is rendered pipelineable.

11 Claims, No Drawings

BITUMEN MODIFICATION USING FLY ASH DERIVED FROM BITUMEN COKE

FIELD OF THE INVENTION

This invention relates to the modification of heavy hydrocarbons such as bitumen from oil sands to render them pipelineable.

BACKGROUND OF THE INVENTION

With the decrease in the reserves of conventional crude oils, there is increasing use of heavy hydrocarbons such as those extracted from oil sands. These heavy hydrocarbons contain a wide range of materials including usually more than 50 wt. % of material boiling above 525° C., equivalent atmospheric boiling point.

In order to transport these heavy hydrocarbons to a point of use, the bitumen typically is mixed with a diluent such as natural gas condensate to reduce the viscosity of the bitumen for pipelining.

Unfortunately, the supply of natural gas condensate may not keep pace with the continuing growth in use of such heavy hydrocarbons. Therefore, there is a need for a method to reduce the viscosity of bitumen to render it pipelineable without adding diluent.

SUMMARY OF THE INVENTION

Accordingly, there is provided a method for lowering the viscosity and specific gravity of a heavy hydrocarbon to render it pipelineable which comprises adding a vanadium and nickel containing coke fly ash to the heavy hydrocarbon; reacting the heavy hydrocarbon in the presence of the fly ash with a molecular hydrogen containing gas under hydroconversion conditions for a time sufficient to lower the viscosity of the hydrocarbon in the range of about 20 to 60 centipoise at 40° C. and to lower the specific gravity in the range of from about 0.925 to about 0.940 at 15° C., whereby the heavy hydrocarbon is rendered pipelineable.

DETAILED DESCRIPTION OF THE INVENTION

The heavy hydrocarbon materials suitable for the use in the practice of the present invention are those which contain a substantial portion, i.e., greater than 50 vol. % of material boiling above 525° C., equivalent atmospheric boiling point. Indeed, of particular interest are the heavy hydrocarbon oils extracted from oil sands most particularly Athabasca and Cold Lake oil sands. Typically, such heavy hydrocarbons at 40° C. have a viscosity exceeding 5,000 centipoise and a specific gravity greater than 1.

The fly ash utilized in the practice of the present invention typically is material that contains greater than about 5,000 ppm vanadium and greater than about 2,000 ppm nickel as well as other metals, silica and clay. It is especially preferred that the fly ash be derived from burning Cold Lake or Athabasca bitumen derived coke. Such fly ash may contain as much as 50 wt. % carbon a majority of which may be organic carbon. Thus in one embodiment of the invention, the carbon containing fly ash is roasted in a furnace at elevated temperatures, e.g., at about 700° C. preferably to a constant weight, to lower the carbon content. This has the advantage that the mass of fly ash required is less than if not roasted. A typical elemental analysis of a suitable fly ash and roasted fly ash are given in Table 1 below.

TABLE 1

| Element | Fly Ash (ppm) | Roasted Fly Ash (ppm) |
|---|---|---|
| Ca | 8,790 | 22,000 |
| Si | 78,000 | 183,000 |
| S | 33,000 | 7,000 |
| Fe | 27,000 | 63,000 |
| Mn | 750 | 1,800 |
| Mo | 850 | 5090 |
| Ni | 6,400 | 21,000 |
| Ti | 10,500 | 23,500 |
| v | 14,250 | 33,800 |
| C | 48.8 | 0 |

In the practice of the present invention, the fly ash is added to the heavy hydrocarbon in the range of about 5 wt. % to about 25 wt. % based on the weight of heavy hydrocarbons. Thereafter, the resulting mixture is reacted with a molecular hydrogen containing gas preferably as a slurry under hydroconversion conditions. The term hydroconversion is used herein to designate a process conducted in the presence of hydrogen in which a portion of the heavy constituents of the hydrocarbon feed is converted to lower boiling hydrocarbon products. Typical hydroconversion conditions include maintaining the reactants at a temperature ranging from about 400° C. to about 450° C. preferably from about 400° C. to about 435° C. at a hydrogen partial pressure ranging from about 800 to about 1500 psig and preferably from about 1,000 to about 1,200 psig.

The slurry of heavy hydrocarbon and coke fly ash is reacted for a time sufficient to lower the viscosity of the heavy hydrocarbon at 40° C. within the range of about 20 to 60 centipoise, and preferably within 40 to 50 centipoise and the specific gravity at 15° C. within the range of about 0.940 to 0.925. Thereafter, it is preferred to separate the so treated hydrocarbon from the fly ash. Optionally, the recovered fly ash can be recycled for use in the process of the invention with or without roasting.

In the practice of the present invention, it is particularly preferred to convert only about 60 to 70 wt. % of the heavy hydrocarbon as measured by ASTM test method D1160 or ASTM test method D2887. Under these conditions, there is substantially no coke formation or asphaltene precipitation and the production of gaseous materials is on the order of 3 to 4 wt. %.

As will be readily appreciated, the vanadium, nickel and other metals in coke fly ash used in the process of the present invention are present largely as metal oxides. Therefore, in one embodiment before adding the fly ash to the heavy hydrocarbon the fly ash is first sulfided. Optionally, the fly ash may be sulfided in the presence of the hydrocarbon. In either case, sulfiding is readily achieved by reacting the fly ash or mixture of fly ash and hydrocarbon as the case may be, with elemental sulfur or a sulfur containing gas, such as hydrogen sulfide in an amount and at a temperature sufficient to convert at least a portion of the metal oxide to the corresponding sulfides. Typical temperatures are above room temperature up to about 385° C. Generally at least a stoichiometric amount of sulfur will be employed.

The following examples will illustrate the invention.

EXAMPLES 1 AND 2

Two batch tests were conducted each using a bitumen having the properties shown in Table II below, one test using fly ash (Example 1) and the other using roasted fly ash (Example 2). In Example 1 a 1 liter stirred autoclave reactor was charged with 275 g of Cold Lake bitumen and 20 g of coke fly ash. $H_2S$ gas was added to about 200 psig. Then hydrogen was added to increase the pressure to about 600 psig. Heating was initiated while stirring the autoclave (2000 rpm) and the autoclave was heated to about 380° C. for 30 minutes to allow catalyst sulfiding to occur. The reactor pressure was then increased to about 1300 psig with hydrogen and continuous hydrogen flow was initiated. At the same time, heating was resumed until the target temperature of 420° C. was reached. The reactor was held at 422° C. for about 90 minutes. The heater was then removed, the autoclave was cooled and hydrogen flow was stopped. When the temperature of the fluids was less than 300° C., the pressure was then vented through a cooled knock-out vessel. When the reactor was at ambient pressure a small hydrogen purge was initiated to remove any remaining acid gas. The reactor was then opened at a temperature of 150 to 175° C. and the contents were rapidly vacuum filtered while hot. After cooling this filtered fraction (217 g) was recombined with the light fraction collected in the knock-out vessel (38 g). The properties of the product oil were then measured and are given in Table 2.

In Example 2, coke fly ash was replaced with coke fly ash which had been roasted at 700° C. to constant weight prior to use. The composition of this roasted fly ash is found in Table 1. This autoclave run was conducted exactly as per Example 1 except in this case, the autoclave was charged with 251 g of bitumen and 10.0 g of roasted coke fly ash. In this example, the reactor was heated to 418° C. for about 2 hours. The properties of the product oil are found in Table 2.

TABLE 2

| | Bitumen Cold Lake | Example 1 Product | Example 2 Product | Example 3 Product |
|---|---|---|---|---|
| Specific Gravity | 0.9972 | 0.9397 | 0.9327 | 0.9267 |
| Viscostiy, cP @40° C. | 7050 | 32 | 18 | 17 |
| Sulfur, Wt. % | 4.62 | 3.1 | 2.9 | 2.3 |
| Ni (ppm) | 72 | 54 | 60 | 20 |
| V (ppm) | 172 | 93 | 95 | 28 |
| 525° C.$^+$ Resid (%) | 51 | 29 | 25 | 17 |

EXAMPLE 3

In a further example, the beneficial properties of fly ash were demonstrated in a continuous lab pilot unit consisting of a tubular reactor. A feed batch was prepared by blending 6.8 wt. % Athabasca bitumen coke fly ash with Cold Lake bitumen. The feed and catalyst mixture was then mixed with hydrogen in-line, pumped through a pre-heater coil to a heated tubular reactor 2.54 cm in diameter and 22.1 cm in length. The reactor was maintained at 445° C. and 1000 psig with a liquid residence time of about 1 hour. The reactor products were separated in 2 stages to recover the liquid product and separate the reaction gases. The reactor had no internals and no mixing was provided. The final liquid product was pressure filtered with nitrogen gas. The filtered liquid product had a viscosity of 17 cP at 40° C. and a specific gravity of 0.9267 at 15° C. per Table 2.

What is claimed is:

1. A method for lowering the viscosity and specific gravity of a heavy hydrocarbon to render it pipelineable which comprises:

adding to the hydrocarbon a coke fly ash containing greater than about 5000 ppm vanadium and 2000 ppm nickel;

reacting the hydrocarbon in the presence of the coke fly ash with a molecular hydrogen containing gas under hydroconversion conditions for a time sufficient to lower the viscosity of the hydrocarbon in the range of about 20 to about 60 centipoise at 40° C. and to lower the specific gravity in the range of about 0.925 to about 0.940 at 15° C. whereby the hydrocarbon is rendered pipelineable .

2. The method of claim 1 wherein the fly ash is added in an amount of about 5 to 25 wt. % based on the weight of hydrocarbon.

3. The method of claim 2 the hydrocarbon is reacted at a temperature between about 400° C. to about 450° C. and hydrogen partial pressure of about 800 to 1500 psig.

4. The method of claim 3 including first roasting the coke fly ash at an elevated temperature to a constant weight.

5. The method of claim 3 or 4 wherein the fly ash is sulfided.

6. The method of claim 5 including separating the fly ash after the reacting step.

7. The method of claim 6 including recycling the separated fly ash.

8. A method for lowering the viscosity and specific gravity of a heavy hydrocarbon containing a substantial portion of material boiling above 525° C. to render it pipelineable which comprises:

obtaining a fly ash containing greater than about 5000 ppm vanadium and 2000 ppm nickel;

contacting the fly ash with elemental sulfur or a sulfur containing gas at a temperature and for a time sufficient to sulfide the fly ash;

adding from about 5 to about 25 wt. % of the fly ash to the hydrocarbon, based on the weight of hydrocarbon;

reacting the hydrocarbon in the presence of the fly ash under hydroconversion conditions for a time sufficient to lower the hydrocarbon viscosity to a range of about 20 to about 60 centipore at 40° C. and the specific gravity to a range of about 0.925 to about 0.940 at 15° C. whereby the hydrocarbon is rendered pipelineable.

9. The method of claim 8 wherein the fly ash is derived from a bitumen coke.

10. The method of claim 9 wherein the fly ash is roasted at an elevated temperature to a constant weight.

11. The method of claim 10 wherein the fly ash is separated after reacting the hydrocarbon and is recycled.

* * * * *